United States Patent [19]

Fisher et al.

[11] 3,932,183

[45] Jan. 13, 1976

[54] PROCESS FOR FABRICATING AN IMPROVED CATHODE RAY TUBE SCREEN STRUCTURE

[75] Inventors: Mahlon B. Fisher, Skaneateles; Anthony V. Gallaro, Auburn; G. Norman Williams, Seneca Falls, all of N.Y.

[73] Assignee: GTE Sylvania Incorporated, Stamford, Conn.

[22] Filed: Oct. 15, 1974

[21] Appl. No.: 514,509

Related U.S. Application Data

[62] Division of Ser. No. 412,143, Nov. 2, 1973.

[52] U.S. Cl. ..... 96/36.1; 427/53; 427/54; 96/34

[51] Int. Cl.[2] ..... G03C 5/00; G03C 7/00

[58] Field of Search ..... 96/36.1, 34; 313/470, 472, 313/474; 117/33.5 CM, 33.5 CP; 427/53, 59

[56] References Cited

UNITED STATES PATENTS

| | | | |
|---|---|---|---|
| 3,659,761 | 3/1971 | Lange | 96/36.1 |
| 3,681,111 | 8/1972 | Kaplan | 117/33.5 CM |
| 3,695,871 | 10/1972 | Lange | 313/472 |
| 3,726,678 | 4/1973 | Robinder | 96/36.1 |
| 3,734,728 | 5/1973 | Kachel | 96/36.1 |
| 3,748,515 | 7/1973 | Kaplan | 313/472 |

*Primary Examiner*—Edward C. Kimlin
*Attorney, Agent, or Firm*—Norman J. O'Malley; Frederick H. Rinn; Robert T. Orner

[57] ABSTRACT

A process for forming a color cathode ray tube screen structure, having means for enhancing the absorption of ambient light and providing improvement in the contrast of the image display involves the deposition of three superimposed substantially continuous window-defining layers of optical filter materials. The primary, secondary and tertiary filter layers have discretely disposed window areas formed therein to expose a pattern of filter areas representing the respective filter materials. The filter windows are of a shaping similar to that of the apertures in a spatially related pattern mask member. Each window exhibits a uniform periphery free of indentations, being so defined by a uniform opaque interstitial encompassment homogeneously made up of the three distinct layers of filter materials. Disposed over the filter windows is a patterned screen of cathodoluminescent phosphor elements, which upon electron excitation produces color emissions that are colormetrically related to the respective filter windows therebeneath.

2 Claims, 11 Drawing Figures

PROCESS FOR FABRICATING AN IMPROVED CATHODE RAY TUBE SCREEN STRUCTURE

CROSS REFERENCES TO RELATED APPLICATIONS

This application is a divisional application of Ser. No. 412,143, filed in the U.S. Pat. Office on Nov. 2, 1973 and assigned to the assignee of the present invention. This divisional application contains matter disclosed but not claimed in three related applications: Ser. No. 412,142, now U.S. Pat. No. 3,884,694, Ser. No. 412,144 now U.S. Pat. No. 3,884,695, and Ser. No. 412,145, now U.S. Pat. No. 3,891,440, all of which were filed on Nov. 2, 1973, and assigned to the assignee of the parent application, Ser. No. 412,143.

BACKGROUND OF THE INVENTION

This invention relates to color cathode ray tubes and more particularly to a process for forming a tube screen structure providing improved contrast of the color image display and to a process for fabricating the same.

Cathode ray tubes of the type employed in color television applications for presenting multi-color display imagery, usually utilize patterned screens that are comprised of repetitive groups of related phosphor materials. Such groupings are normally disposed as bars, stripes or dots depending upon the type of color tube structure under consideration. For example, in the well known shadow mask tube construction, the screen pattern is conventionally composed of a vast multitude of repetitive tri-color emissive areas formed of selected cathodoluminescent phosphors, which, upon predetermined excitation, produce additive primary hues to provide the desired color imagery. Associated with the screen and spaced therefrom is a foraminous structure or patterned mask member having a vast multitude of discretely formed apertures therein. Each of the apertures in the mask member is related to a specific tri-component grouping of related phosphor areas of the screened pattern in a spaced manner therefrom to enable the selected electron beams traversing the apertures to impinge the proper screen areas therebeneath.

Several approaches have been proposed to increase the contrast ratio of the color screen display. One such proposal to improve contrast by absorbing ambient light is the use of a neutral density filter member in the form of a tinted cover plate which is superposed on the viewing panel of the tube. Since neutral density filters are not appreciably selective in the visible band of the color spectrum, the intended absorptive efficiency can not be fully realized in eliminating the reflective ambient light falling within the spectrum bandpass of the display emission. Another proposal for increasing contrast ratio of the color image display is the utilization of a tinted faceplate or viewing panel per se. Tinting of the faceplate attenuates the light transmission of that member, thereby reducing the evidenced brightness of the phosphor emissions, in addition to absorptive shortcomings similar to those of the aforementioned neutral density filter.

Another approach to improving contrast of the color screen image, particularly in a dot-type patterned screen, has been the development of a screen structure wherein the dot-defining interstitial spacing between the respective color-emitting dots of the screen pattern is formed of an opaque light absorbing material. In essence, each phosphor dot is enclosed or defined by a substantially dark encompassment which collectively comprise a foraminous pattern in the form of a windowed webbing having an array of substantially opaque connected interstices. While this black surround feature reduces the reflected ambient light in the non-fluorescing areas of the screen, it does not reduce the ambient light reflected from the panel areas associated with the phosphor dots, which areas evidence a high degree of reflectivity.

A further proposal for enhancing contrast of the screen display has been the use of optical filter elements disposed relative to the respective color-emitting phosphors comprising the screen pattern. One such optical filter proposal utilizes circular filter elements having large oversize diameters dimensioned so that their outer peripheral portions overlap in a non-uniform manner to produce an irregularly shaped or indented filter area surrounded by a non-uniform interstitial webbing. These variations in the dot surround-webbing effect a variable absorbency of the ambient light thereby detracting from the complete achievement of the intended contrast enhancement.

OBJECTS AND SUMMARY OF THE INVENTION

It is an object of the invention to reduce the aforementioned disadvantages and to provide a process for forming an improved screen structure for a color cathode ray tube evidencing improved display contrast.

It is another object to provide a process for forming an improved color cathode ray tube screen structure having optical filter elements therein surrounded by an opaque interstitial webbing of uniform thickness.

It is another object to provide a process for forming an improved color cathode ray tube screen structure incorporating optical filter windows therein, each window in the screen structure having a uniform peripheral encompassment free of indentation.

These and other objects and advantages are achieved in one aspect of the invention by providing a process for fabricating a discretely patterned multi-window color screen structure disposed on the inner surface of a cathode ray tube viewing panel. Each of the window areas is surrounded by a uniform opaque interstitial encompassment that exhibits a peripherally defined smoothness free of indentations, such shaping being similar to the shape of the apertures in a spatially related pattern mask member. The screen structure is comprised of a transparent primary layer of a first heat formable optical filter material that is adhered to the inner surface of the viewing panel. This primary layer has open second and third pattern window areas formed therein. A secondary layer of a second heat formable optical filter material is superimposed on the primary layer and the second of the window pattern areas formed therein to provide an array of window-defined second filter elements in the screen structure. The secondary layer has open first and third patterned window areas formed therein whereof the open first window pattern array defines portions of the primary layer to provide a delineation of first filter elements in the screen structure that are free of peripheral indentations. The open third window pattern in the secondary filter layer is superimposed over the open third window pattern in the primary filter layer. A tertiary layer of a third heat formable optical filter material is disposed in a superposed manner over the secondary layer and the open third superposed window pattern areas to provide an array of third filter elements in the screen structure. This tertiary layer has open first and second window patterns superimposed on like window areas in the secondary layer. The three superimposed optical filter material layers are combined uniformly to provide a substantially opaque uniform interstitial webbing fully surrounding each of the respective filter windows in the color screen structure; each of the windows having a uniform peripheral encompassment free of indentations. This opaquely defined filter windowed structure has three patterns of related cathodoluminescent phosphor elements disposed thereover to complete the color screen structure.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

The improved discretely patterned multi-window color cathode ray tube structure described herein will be delineated as having substantially round filter window areas therein surrounded by a substantially uniform opaque interstitial encompassment; each of the window areas having a defined peripheral smoothness free of indentations. Other window configurations, such as elongated and ovate shapings, are intended to be in keeping with this disclosure, such configurations being similar to the shape of the apertures in a spatially related pattern mask member. The screen structure so described may be utilized in either post deflection or shadow mask types of color cathode ray tube constructions.

Figure 1A:
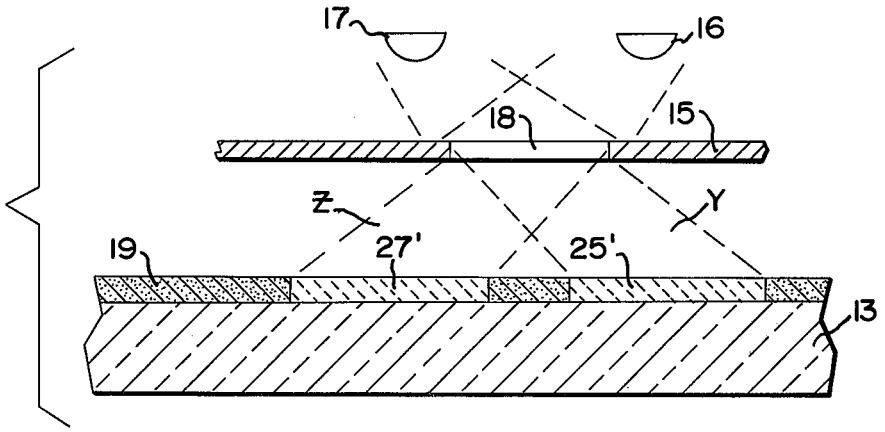
FIGS. 1*a* and 1*b* are cross-sectional views illustrating deposition of the primary layer of the first optical filter material.
Figure 1B:
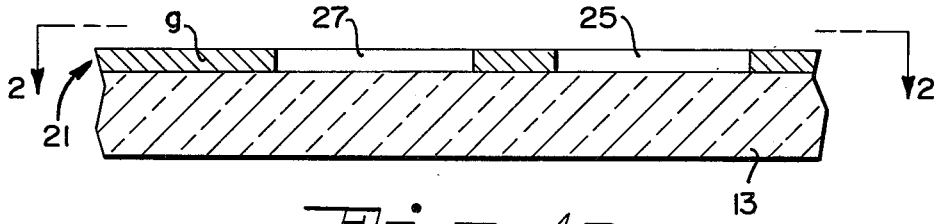
Figure 1C:
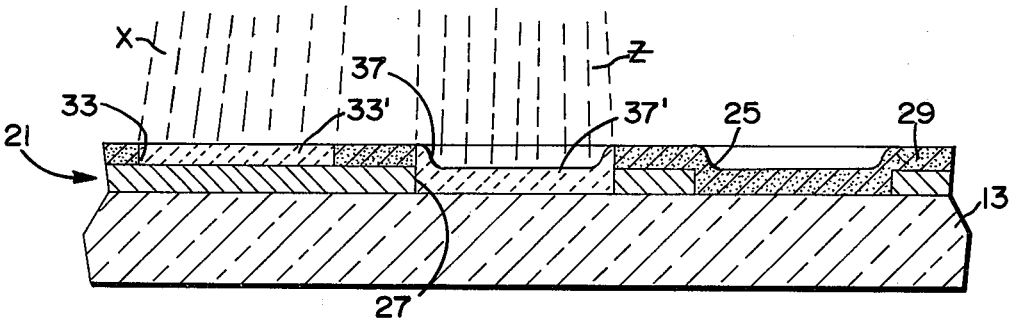
FIGS. 1*c* and 1*d* are cross-sectional views relating to the deposition of the secondary layer of a second optical filter material.
Figure 1D:
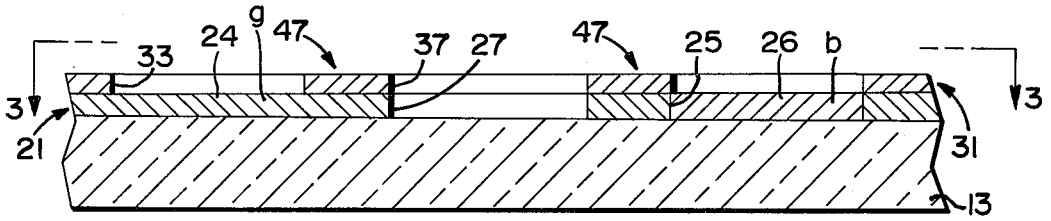
Figure 1E:
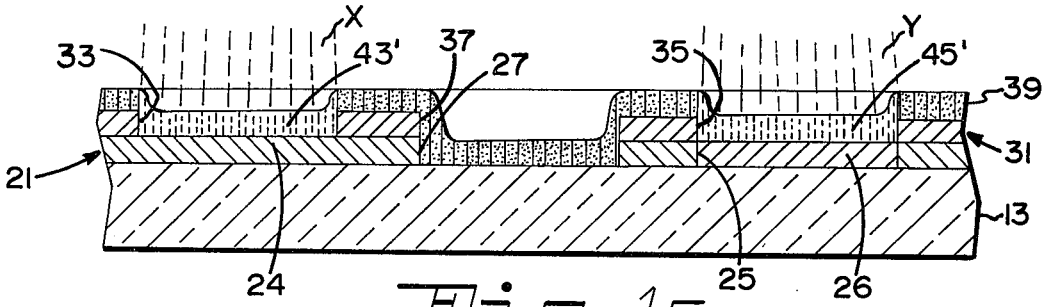
FIGS. 1*e* and 1*f* are sectional views illustrating the deposition of tertiary layer of the third optical filter material.
Figure 1F:
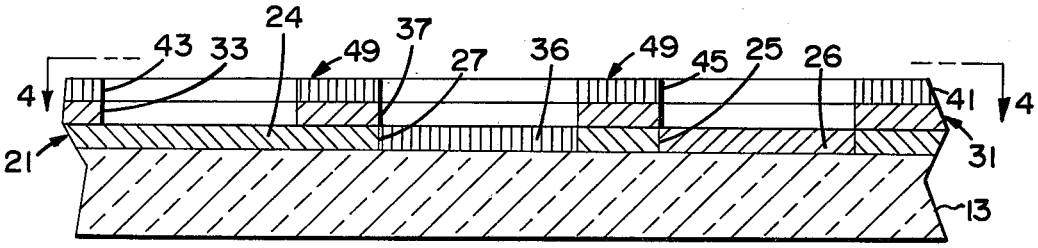
Figure 1G:
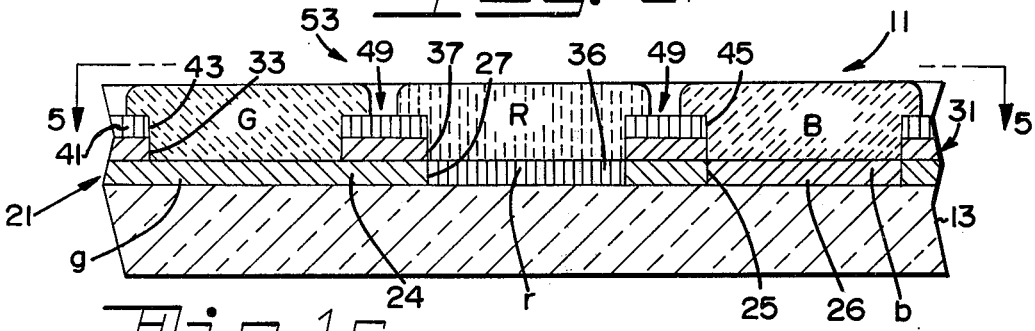
FIG. 1*g* is a sectional view showing the completed screen structure.
Figure 5:
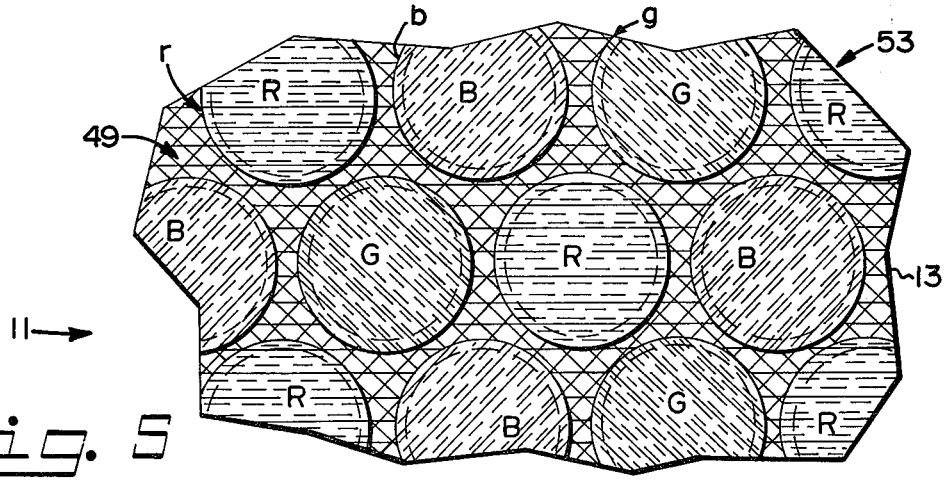
FIG. 5 is a plan view of the completed screen structure taken along the line 5—5 of FIG. 1*g*.

In this instance, a multi-element filter window screen structure 11 of the invention as illustrated in FIGS. 1*g* and 5 is of the type, for example, as that used in a conventional shadow mask type of color cathode ray tube. As is well known, conventional tubes of this type utilize several electron beams which are directed to converge at a multi-apertured shadow mask, not shown, and thence pass through the apertures therein to discretely impinge selected areas of the composite screen structure spaced therebeneath. The multi-layered screen structure 11 as shown in FIGS. 1*g* and 5, is disposed on the inner surface of the cathode ray tube viewing panel 13. The visible light transmissivity of this glass panel is relatively high being preferably in the neighborhood of 90 percent, the light attenuation of the glass per se being inherent to the elemental composition thereof. Adhered to the inner surface of this panel is a substantially continuous and substantially transparent primary layer 21 of a first heat formable optical filter material representative of a primary hue. This primary layer has substantially round second and third patterns of related open window areas, 25 and 27 respectively, formed therein each being free of peripheral indentations. The hue of this primary layer is a primary color as, for example, green *g*, and is of a first organometallic luster composition as will be more fully explained subsequently in this specification. Superposed on this primary filter layer 21 is a substantially continous and substantially transparent secondary layer 31 of a second heat formable optical filter material differing in hue from that of the primary layer, as for example, a blue *b* coloration resultant of another or second organometallic luster composition. This secondary layer 21 overlays and fills in the second of the window pattern areas 25 formed in the primary layer 21 to provide an array of window defined second filter elements 26 in the screen structure. Additionally, the secondary layer has first and third patterns of discrete window areas, 33 and 37 respectively, formed therein whereof the first window pattern array 33 defines areal portions of the first or primary layer 21 to provide first filter elements 24 in the screen structure. The third window pattern 37 in the secondary layer 31 is superimposed over the third window pattern 27 in the primary layer 21. A substantially continuous and substantially transparent tertiary layer 41 of a third heat formable optical filter material is superposed over the secondary layer 31 and fills in the third window pattern areas 37 therein and the underlying window pattern areas 27 to provide the array of defined third filter elements 36 in the screen structure 11. This tertiary layer 41 is of a hue differing from that of the primary and secondary layers, as for example red *r*, and is formed of a third organometallic luster material having open first and second window patterns, 43 and 45 respectively, that are superposed on like window areas 33 and 25, in the secondary and primary filter layers 31 and 21 respectively. The three superimposed layers 21, 31 and 41 of diverse primary color optical filter materials comprising the multi-window structure 11 are combined in a discrete manner to provide a substantially opaque uniform interstitial webbing 49 that fully surrounds each of the respective filter windows in the screen structure by an opaque uniform peripheral encompassment that is free of indentations. Disposed over these respective filter window areas of the screen structure are patterned groupings of compatible green G, blue B and red R cathodoluminescent phosphor elements, which upon electron excitation produce color-emissions that are colormetrically related to the respective filter windows 24 *g*, 26 *b*, and 36 *r* therebeneath. The color emissions of the phosphor materials are selectively enhanced by transmission through the associated filtering components.

Portions of the process for fabricating the aforedescribed interstitially defined first 24, second 26 and third 36 filter window areas comprising the color cathode ray tube screen structure 11 are delineated in FIGS. 1*a* through FIG. 1*f* of the drawings.

Prior to the initiation of the screen structure fabricating process, the viewing or face panel portion 13 of the cathode ray tube is cleaned in a normal manner by washing particularly the interior of the panel with a 5 to 10 percent aqueous solution of hydrofluoric acid, whereupon the panel is water rinsed and dried. The first step in fabrication of the screen structure entails uniformly coating the interior surface of the panel 13 with a primary layer of a liquid mixture 19 of a positive photosensitive resist material and a first organometallic luster compound. Positive photosensitive resist is a light activated material that, when exposed to actinic radiation, such as uv, becomes polymerically degraded thereby acquiring solubility in its development solvent. A typical positive photosensitive resist material is one such as that designated AZ-111, distributed by Shipley Company, Incorporated, Newton, Mass. The first organometallic luster compound, as mixed with the positive photosensitive resist, is selected from the group of compounds known as liquid luster preparations. Such compositions are base metal organic solutions of metals such as tin, iron, bismuth, titanium and the like, which may contain additions of metalloorganic compounds of precious metals dissolved in organic solvents. The color of the liquid luster preparation usually bears no semblance to the desired optical filter hue resultant from subsequent heat transformation. While luster preparations are available commercially, their formulary compositions are usually considered to be proprietary with the manufacturer of the product. A metallic luster material suitable for use as the first luster component in this screen structure may be, for example, a greenproducing luster material, such as A-1128, which is commercially available from Hanovia Liquid Gold Division, Englehard Industries, Incorporated, East Newark, N.J. The proportional composition of the primary coating mixture is adapted to provide adequate functioning of the photo-resist in conjunction with the amount of luster material required to provide the desired attenuation of the resultant luster filter component. Appropriate proprietary thinners for the respective photo-resist and luster materials are added as desired to adjust the viscosity of the coating mixture to expedite efficient application thereof over the panel surface. It has been found that a coating viscosity in order of 8 to 10 centipoises is appropriate for spin application of the material when rotating the panel in substantially the range of 90 to 150 rpm, whereupon a uniformly applied coating thickness in the order of 2.5 to 4 microns is achieved.

After drying the coated panel, the aperture pattern mask 15 is positioned in spaced relationship thereto as shown in FIG. 1*a*. The primary coating is then discretely light exposed by directing actinic radiations Y and Z from two spaced apart positions 16 and 17 through the multiple apertures in the pattern mask, one of which is shown. The respective directed light beams, originating from sources oriented to expose the second and third window patterns, are sized by the mask aperture 18 whereupon the light impinged second and third window areas, 25' and 27' respectively, of the coating are usually slightly larger than the area of the formative aperture 18. After exposure, the primary coating is developed, whereupon the exposed areas thereof, being polymerically degraded by the uv radiation, are removed to define open second and third filter window patterns in the primary coating. The development material used in this instance is one such as a proprietary liquid developer designated as AZ303, which is commercially available from the aforenoted Shipley Company. A suitable developer concentration is, for example, one part of developer combined with four parts of water. Upon development, the panel is rinsed with water to remove any residual development materials.

Figure 2:
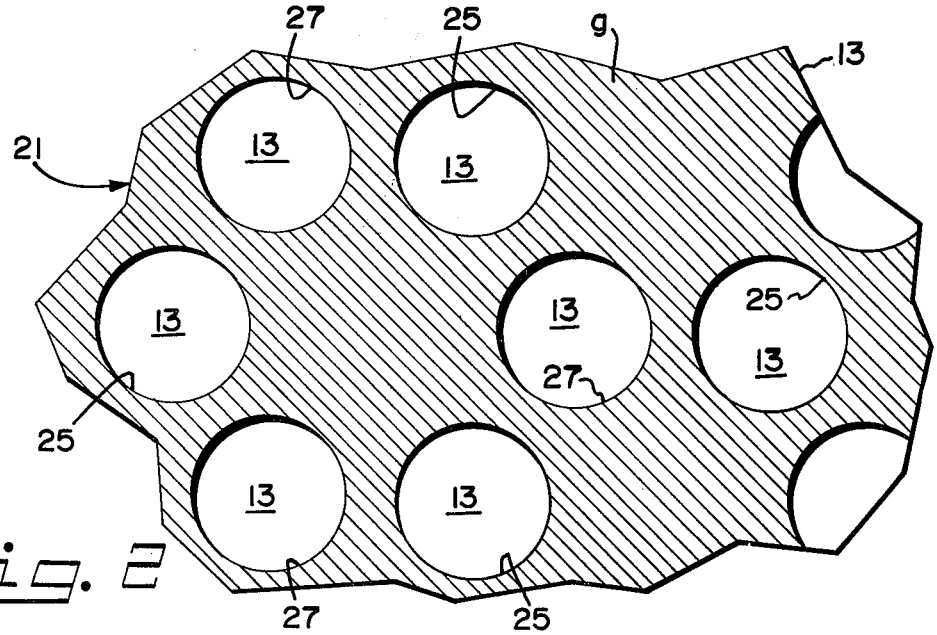
FIG. 2 is a plan view of a partially constructed screen structure taken along the line 2—2 of FIG. 1b showing the primary layer of the first optical filter material and the open second and third patterned window areas formed therein.

The next step in the process involves heating the panel with the patterned luster film thereon in a controlled oxygen atmosphere at a temperature in the region of 450° to 500° Centigrade. This baking or firing thermally decomposes the resist component of the primary coating mixture and oxidizes the first or green-producing luster material changing the color thereof to transform and adhere a substantially continuous and transparent glassy primary layer 21 of green-hued *g* first optical filter material having open second and third filter windows 25 and 27 respectively, formed therein. Reference is directed to FIGS. 1*b* and 2. The required thickness of the transformed green-hued luster filter material is extremely thin being less than 0.5 microns. It has been found that the thickness of the respective optical filter materials comprising the layered screen structure should each exhibit a light transmission in the order of 60 percent to provide the desired opacity of the interstitial webbing.

Figure 3:
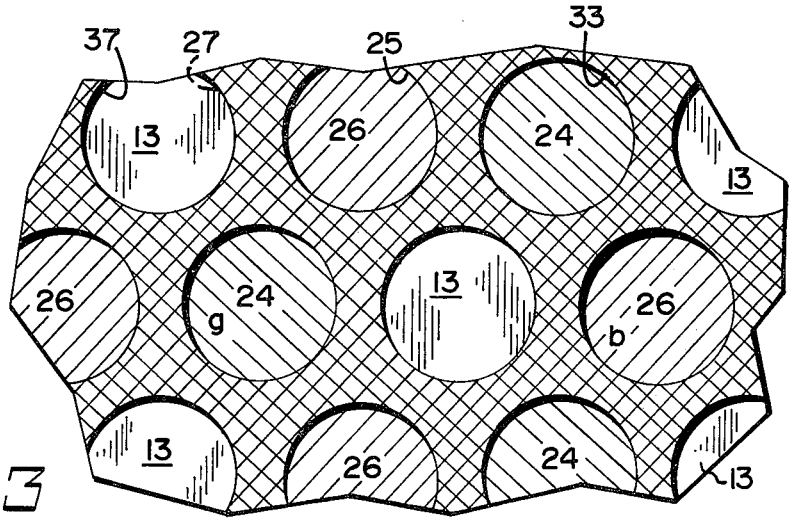
FIG. 3 is a plan view of a partially constructed screen structure taken along the line 3—3 of FIG. 1*d* illustrating the superposed primary and secondary filter material layers and the window elements associated respectively therewith.

The discretely patterned panel, having the primary layer 21 of filter material adhered thereon, is next coated with a secondary layer 29 of another liquid mixture including the aforedescribed positive photosensitive resist material and a second color-producing organometallic luster compound. The second luster filter material may be, for example, a blue-producing composition such as No. 130-F, which is also available from Englehard Industries. With reference to FIG. 1*c*, the coated panel is then dried and exposed to specific actinic radiations X and Z emanating from two spaced-apart positions, not shown, oriented to produce the first and third pattern areas, the light therefrom being directed through the apertures of the mask to impinge and degrade the resist coating in those areas 33' and 37' of the secondary coating 29 subsequently occupied by the first and third arrays of filter windows. The exposed secondary coating is then developed with positive photoresist developer as previously described, whereupon the areas of polymerically degraded exposed coating material 33' and 37' are removed from the first and third pattern window areas. The secondary coating 29 fills in the second window openings 25 in the primary filter layer 21. In referring to FIGS. 1*d* and 3, after rinsing and drying, the panel is again subjected to heating in a controlled oxygen atmosphere in the temperature range of 450° to 500°C. to thermally decompose the resist portion of the secondary coating mixture and oxidize the second luster material. This baking procedure transforms and adheres a substantially continuous and transparent glassy secondary layer of the second optical filter material 31 having an open third filter window 37 therein and an open first filter window 33 which defines and displays a first filter element area 24 of the first optical filter material 21 therebeneath. The second window opening 25 in the primary filter layer 21, having the secondary filter material disposed therein, defines the second filter element 26. At this stage in fabrication, the interstitial region 47 is comprised of two uniform layers of filter materials.

Figure 4:
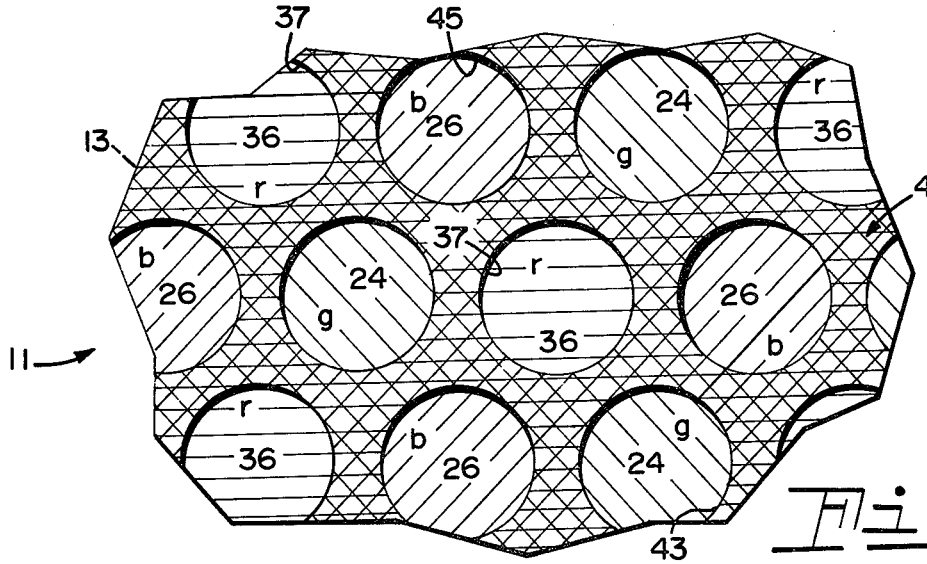
FIG. 4 is a plan view of the screen structure taken along the line 4—4 of FIG. 1*f* showing the relationship of the superposed primary, secondary and tertiary layers of the optical filter materials and the respective filter windows formed therein.

The panel having the two patterned filter layers 21 and 31 disposed thereon in a superposed manner is next coated with a tertiary layer of still another liquid mixture 39 incorporating the previously mentioned positive photoresist material and a third organometallic luster compound. The luster preparation for this third filter layer may, for example, be a red-producing luster such as Red Rose No. 9736 or Ruby Red No. 9761, such compositions being commercially available from Englehard Industries. In referring to FIG. 1*e*, after drying, the tertiary coating is exposed by directing controlled actinic radiations X and Y from two positions, i.e., the first and second window exposure orientations, through the patterned mask to effect specific degradation of discrete areas 43' and 45' of the tertiary positive resist coating 39 in the areas already occupied by the underlying first and second patterned filter elements 24 and 26 respectively. Developing the exposed tertiary coating removes the degraded exposed areas 43' and 45' of that coating material which had been disposed over the first and second filter elements 24 and 26. After rinsing and drying, the panel is again heated in a controlled oxygen atmosphere to thermally decompose the resist component of the tertiary coating mixture and oxidize the third luster material 39. This heating transforms and adheres a substantially continuous and transparent glassy tertiary layer of the third or red optical filter material 41 having open first 43 and second 45 filter windows therein for displaying the first and second optical filter elements 24 and 26. The third filter element 36 associated with the tertiary layer 41 is defined by the third patterned superimposed open windows 27 and 37 previously formed in the primary and secondary filter layers. Such is evidenced in FIGS. 1*f* and 4. The superimposed primary 21, secondary 31, and tertiary 41 filter layers being of primary colors, namely green *g*, blue *b* and red *r* filtering components provide in combination a substantially opaque uniform interstitial webbing 49 fully surrounding each of the respective round filter windows in the screen structure 11. Each filter window is evenly defined by a uniform peripheral encompassment that is free of indentations.

With reference to FIGS. 1*g* and 5, upon completing fabrication of the interstitially defined multi-windowed optical filter screen structure as hereinbefore described, the respective green G, red R and blue B cathodoluminescent phosphor elements are suitably disposed as a patterned screen 53 over the appropriate *g*, *r*, and *b* filter windows. Deposition of the pattern of color-emitting phosphor elements, is accomplished in a conventional manner by one of the procedures well known in the art. Therefore, further details of the phosphor screening process will not be considred considered It may be expedient from the standpoint of phosphor brightness and color emission, to form a multi-windowed screen structure wherein only one or two of the window areas have the respective optical filter materials disposed therein. Whether or not a filter material is evidenced in a defined window area of the structure is determined by the selection of the light exposure positions during fabrication; for example, if it is found beneficial to have a window area open or free of discrete optical filtering material, that window area has specific actinic radiation directed to it during each of the primary, secondary and tertiary filter layer exposures.

It may be desired to modify the sizes of the apertures in the patterned mask member either before or after forming of the screen structure; as for example, having filter window openings in the opaque interstitial webbing that are smaller than the associated apertures in the patterned mask member subsequently utilized in the operable tube. In one consideration, the mask apertures initially utilized in forming the filter windows and the defining interstitial webbing, may be subjected to a subsequential chemical etching process to enlarge their sizes thereby effecting the desired dimensional differential between the final sized apertures used in tube operation and the initially sized apertures utilized in forming the windows in the interstitial webbing. Prior art is replete with a variety of techniques for modifying the sizes of the pattern mask apertures utilized in the forming of or the operation of specific types of color screen structures. There are several disclosures wherein changing of the aperture sizes is executed by deposition within the aperture openings of peripheral fillin substances applied, as for example, by painting, dipping, electrophoresis, electroplating and vaporization. Such modifications of the apertures of the mask member, may be utilized as desired in conjunction with the screen structure of the invention.

Thus, there is provided a process for fabricating an improved color cathode ray tube screen structure that incorporates smoothly defined optical filter elements therein which are surrounded by an opaque interstitial webbing of uniform thickness. The resultant uniformity of the opaque interstitial encompassment provides enhanced absorbency of the ambient light thereby effecting improved contrast of the color display.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a color cathode ray tube viewing panel whereon a patterned cathodoluminescent screen structure formed of first, second and third pattern elements is disposed on an interior surface of said panel relative to a multiple aperture patterned mask spacedly positioned adjacent thereto, a process for forming an improved multi-windowed screen structure defined by a webbing of uniform opaque interstices disposed on the interior surface of said panel prior to the fabrication of the phosphor screen thereon, each of said window areas having a layer of selected substantially transparent optical filter material disposed therein and evidencing a peripheral shaping free of indentations similar to that of the formative aperture in said pattern mask, said process comprising the steps of:

coating the interior of said panel with a primary layer of a liquid mixture of a positive photosensitive resist material and a first organometallic luster compound;

drying said coated panel;

exposing said primary coating by directing actinic radiations from two discrete positions through the multiple apertures in said pattern mask to effect degradation of those portions of the primary positive resist coating in the areas subsequently occupied by said second and third filter pattern windows;

developing said exposed primary coating with positive photoresist developer by removing the degraded exposed coating material in said second and third filter pattern window areas;

rinsing said developed panel to remove development materials;

heating said patterned panel in a controlled oxygen atmosphere to thermally decompose said resist material and oxidize said first luster material to form and adhere a substantially continuous and transparent primary layer of said first optical filter material having second and third open filter windows therein;

coating said panel with a secondary layer of a liquid mixture of said positive photosensitive resist material and a second organometallic luster compound;

drying said coated panel;

exposing said secondary coating by directing actinic radiation from two positions through said patterned mask to effect degradation of said secondary positive resist coating in the areas subsequently occupied by said first and third filter pattern windows;

developing said exposed secondary coating with positive photoresist developer by removing the degraded exposed coating material in said first and third filter pattern window areas;

rinsing said developed panel to remove development materials;

heating said patterned panel in a controlled oxygen atmosphere to thermally decompose said resist material and oxidize said second luster material to form and adhere a substantially continuous and transparent secondary layer of said second optical filter material having an open third filter window therein and a defined first filter window displaying said first optical filter material therein;

coating said panel with a tertiary layer of a liquid mixture of said positive photosensitive resist material and a third organometallic luster compound;

drying said coated panel;

exposing said tertiary coating by directing actinic radiations from two positions through said patterned mask to effect degradation of said tertiary positive resist coating in the areas occuppied by said first, and second filter pattern windows;

developing said exposed tertiary coating with positive photoresist developer by removing the degraded exposed coating material in said first and second filter pattern window areas;

rinsing said developed panel to remove development materials; and heating said patterned panel in a controlled oxygen atmosphere to thermally decompose said resist material and oxidize said third luster material to form and adhere a substantially continuous and transparent tertiary layer of said third optical filter material having open first and second filter windows therein displaying said first and second optical filter material respectively therein, said third filter window associated with said tertiary layer being defined by the third pattern superposed open windows in said primary and secondary filter layers; said superimposed primary, secondary and tertiary filter layers providing in combination a substantially opaque uniform interstitial webbing fully surrounding each of the respective filter windows in said screen structure whereof the uniform peripheral encompassment of each filter window is free of indentations.

2. In the viewing panel of a color cathode ray tube whereon a patterned cathodoluminescent screen structure formed of first, second and third patterned elements is disposed on an interior surface of said panel relative to a multiple apertured patterned mask spacedly positioned adjacent thereto, a process for forming a multi-windowed screen structure defined by a webbing of uniform opaque interstices disposed on the interior surfaces of said panel prior to the fabrication of the phosphor screen thereon, at least one of said window areas having a layer of selected substantially transparent optical filter material disposed therein and evidencing a peripheral shaping free of indentations similar to that of the formative aperture in said patterned mask, said process comprising the steps of:

coating the interior of said panel with a primary layer of a liquid mixture of a positive photosensitive resist material admixed with a first heat formable optical filter material;

exposing said primary coating by directing actinic radiations from at least two spaced apart positions through the multiple apertures in said patterned mask to effect degradation of those portions of the primary positive resist coating in the areas subsequently occupied by the exposed pattern filter window areas;

developing said exposed primary coating to remove said degraded exposed coating material from said exposed filter pattern window areas;

heating said patterned panel to thermally decompose said resist material and transform and adhere a substantially continuous and substantially transparent primary layer of said first optical filter material having at least two open filter window areas therein;

coating said panel with a secondary layer of a liquid mixture of said positive photosensitive resist material and a second heat formable optical filter material;

exposing said secondary coating by directing actinic radiation from at least two spaced apart positions through said patterned mask to effect degradation of said secondary positive resist coating in the areas subsequently occupied by the exposed filter pattern window areas;

developing said exposed secondary coating by removing said degraded exposed coating material in said exposed filter pattern window areas;

heating said patterned panel to thermally decompose said resist material and transform and adhere a substantially continuous and substantially transparent secondary layer of said second optical filter material having at least two open filter window areas formed therein;

coating said panel with a tertiary layer of a liquid mixture of said positive photosensitive resist material and a third heat formable optical filter material;

exposing said tertiary coating by directing actinic radiations from at least two positions through said patterned mask to effect degradation of said tertiary positive resist coating in areas to be occupied by said exposed filter pattern window areas;

developing said exposed tertiary coating by removing the degraded exposed coating material in said exposed pattern window areas; and heating said patterned panel to thermally decompose said resist material and transform and adhere a substantially continuous and transparent tertiary layer of said third optical filter material having at least two open filter window areas therein, said superimposed primary, secondary and tertiary filter layers providing at least one window area having a specific filter material exposed therein, and wherein said superposed filter layers provide in combination a substantially opaque and uniform interstitial webbing fully surrounding each of the respective window areas in said screen structure whereof the uniform peripheral encompassment of each window area is free of indentations.

* * * * *

UNITED STATES PATENT OFFICE

CERTIFICATE OF CORRECTION

PATENT NO. : 3,932,183

DATED : January 13, 1976

INVENTOR(S) : Mahlon B. Fisher, Anthony V. Gallaro and G. Norman Williams

It is certified that error appears in the above-identified patent and that said Letters Patent are hereby corrected as shown below:

Col. 4, line 31: Change "layer 21" to read --- layer 31 ---

Signed and Sealed this

*sixth* Day of *April 1976*

[SEAL]

*Attest:*

RUTH C. MASON
*Attesting Officer*

C. MARSHALL DANN
*Commissioner of Patents and Trademarks*